US012264872B2

(12) United States Patent
Allard et al.

(10) Patent No.: US 12,264,872 B2
(45) Date of Patent: Apr. 1, 2025

(54) INSULATION PANEL ASSEMBLY FOR A REFRIGERATION UNIT

(71) Applicant: Whirlpool Corporation, Benton Harbor, MI (US)

(72) Inventors: Paul Bennett Allard, Coloma, MI (US); Chad Eric McCray, Stevensville, MI (US); Dustin Michael Miller, South Bend, IN (US); Jeffrey P. Beckner, Niles, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 240 days.

(21) Appl. No.: 17/972,124

(22) Filed: Oct. 24, 2022

(65) Prior Publication Data

US 2024/0133615 A1 Apr. 25, 2024
US 2024/0230210 A9 Jul. 11, 2024

(51) Int. Cl.
*F25D 23/06* (2006.01)

(52) U.S. Cl.
CPC ..... *F25D 23/062* (2013.01); *F25D 23/066* (2013.01); *F25D 2201/14* (2013.01)

(58) Field of Classification Search
CPC .... F25D 23/062; F25D 23/066; F25D 23/065; F25D 2201/14; F25D 2323/06
See application file for complete search history.

(56) References Cited

U.S. PATENT DOCUMENTS 1,459,280 A 6/1923 Card
2,000,882 A 5/1935 Comstock
4,745,015 A 5/1988 Cheng et al.
5,027,574 A 7/1991 Phillip
5,318,108 A 6/1994 Benson et al.
5,345,814 A 9/1994 Cur et al.
5,500,305 A 3/1996 Bridges et al.
5,695,844 A 12/1997 Neeser et al.
5,765,379 A 6/1998 Jensen
5,900,299 A 5/1999 Wynne
5,934,085 A 8/1999 Suzuki et al.
6,106,449 A 8/2000 Wynne
8,449,177 B2 5/2013 Kvisteroy et al.
9,321,237 B2 4/2016 Hiemeyer et al.
9,976,798 B2 5/2018 Mukherjee et al.
10,605,520 B1 3/2020 Ekshinge et al.
(Continued)

FOREIGN PATENT DOCUMENTS

EP 3693649 A1 8/2020
GB 385326 A1 12/1932
(Continued)

*Primary Examiner* — Daniel J Rohrhoff
(74) *Attorney, Agent, or Firm* — Price Heneveld LLP

(57) ABSTRACT

An insulation panel assembly for a refrigeration unit includes a first panel, a second panel coupled to the first panel, an evacuation hub defining an evacuation port that extends from an inlet to an outlet and a groove that extends around the inlet, and a conduit engaged with the evacuation hub. The second panel defines an aperture and includes a protruding surround that extends around the aperture. The evacuation hub is positioned such that the inlet is aligned with the aperture defined by the second panel and the groove receives the protruding surround of the second panel therein. Further, the conduit extends into the evacuation port via the outlet.

18 Claims, 7 Drawing Sheets

(56) References Cited

U.S. PATENT DOCUMENTS

| | | | | |
|---|---|---|---|---|
| 10,746,343 | B2 | 8/2020 | Allard et al. | |
| 10,781,963 | B2 | 9/2020 | Uekado et al. | |
| 10,941,975 | B2 | 3/2021 | Choi et al. | |
| 10,995,488 | B1 | 5/2021 | Allard et al. | |
| 11,021,905 | B1 * | 6/2021 | Ekshinge | E06B 3/2632 |
| 11,047,517 | B2 | 6/2021 | Vaze et al. | |
| 11,300,354 | B2 | 4/2022 | Frattini et al. | |
| 11,427,998 | B2 | 8/2022 | Allard et al. | |
| 11,650,004 | B1 * | 5/2023 | Hunter | F25D 23/028 428/69 |
| 2004/0058119 | A1 | 3/2004 | Wynne | |
| 2005/0235682 | A1 | 10/2005 | Hirai et al. | |
| 2016/0174734 | A1 | 6/2016 | Artwohl et al. | |
| 2016/0356637 | A1 | 12/2016 | Kunapuli et al. | |
| 2017/0159998 | A1 * | 6/2017 | Dherde | B29C 44/5627 |
| 2017/0167781 | A1 | 6/2017 | Mukherjee et al. | |
| 2019/0145697 | A1 * | 5/2019 | Naik | F25D 23/062 312/400 |
| 2019/0293339 | A1 | 9/2019 | Gomes et al. | |
| 2020/0033049 | A1 | 1/2020 | Dherde et al. | |
| 2020/0103067 | A1 * | 4/2020 | Allard | F25D 23/066 |
| 2020/0132243 | A1 | 4/2020 | Vaze et al. | |
| 2020/0256504 | A1 * | 8/2020 | Frattini | F16L 59/065 |
| 2020/0278149 | A1 | 9/2020 | Ekshinge et al. | |
| 2021/0108851 | A1 * | 4/2021 | Allard | F25D 23/028 |
| 2021/0148113 | A1 * | 5/2021 | Allard | A47L 15/4209 |
| 2021/0190255 | A1 | 6/2021 | Allard et al. | |
| 2022/0074645 | A1 | 3/2022 | Gomes et al. | |

FOREIGN PATENT DOCUMENTS

| | | | |
|---|---|---|---|
| JP | 07148752 | A | 6/1995 |
| JP | 0868591 | A | 3/1996 |
| WO | 9927312 | A1 | 6/1999 |
| WO | 2012176880 | A1 | 12/2012 |

* cited by examiner

INSULATION PANEL ASSEMBLY FOR A REFRIGERATION UNIT

BACKGROUND OF THE DISCLOSURE

The present disclosure generally relates to an insulation panel assembly for a refrigeration unit. More specifically, the present disclosure relates to an insulation panel assembly that includes an evacuation hub and a conduit.

SUMMARY OF THE DISCLOSURE

According to one aspect of the present disclosure, an insulation panel assembly for a refrigeration unit includes a first panel, a second panel coupled to the first panel, an evacuation hub defining an evacuation port that extends from an inlet to an outlet and a groove that extends around the inlet, and a conduit engaged with the evacuation hub. The second panel defines an aperture and includes a protruding surround that extends around the aperture. The evacuation hub is positioned such that the inlet is aligned with the aperture defined by the second panel and the groove receives the protruding surround of the second panel therein. Further, the conduit extends into the evacuation port via the outlet.

According to another aspect of the present disclosure, an assembly for a refrigeration unit includes a structural enclosure that defines an aperture and includes a protruding surround that extends around the aperture, an evacuation hub defining an evacuation port that extends from an inlet to an outlet and a groove that extends around the inlet, and a conduit engaged with the evacuation hub. The evacuation hub is positioned such that the inlet is aligned with the aperture defined by the structural enclosure and the groove receives the protruding surround of the structural enclosure therein.

According to yet another aspect of the present disclosure, an insulation panel assembly for a refrigeration unit includes a liner, a wrapper coupled to the liner, such that the liner and wrapper define an insulating cavity therebetween, an evacuation hub defining an evacuation port that extends from an inlet to an outlet and an annular groove that encircles the inlet, and a conduit engaged with the evacuation hub. The wrapper defines an aperture and includes an annular protruding surround that extends away from the insulating cavity and around the aperture. The evacuation hub is positioned such that the inlet is aligned with the aperture defined by the wrapper and the annular groove receives the annular protruding surround. Further, the conduit extends into the evacuation port via the outlet.

These and other features, advantages, and objects of the present disclosure will be further understood and appreciated by those skilled in the art by reference to the following specification, claims, and appended drawings.

Figure 1:
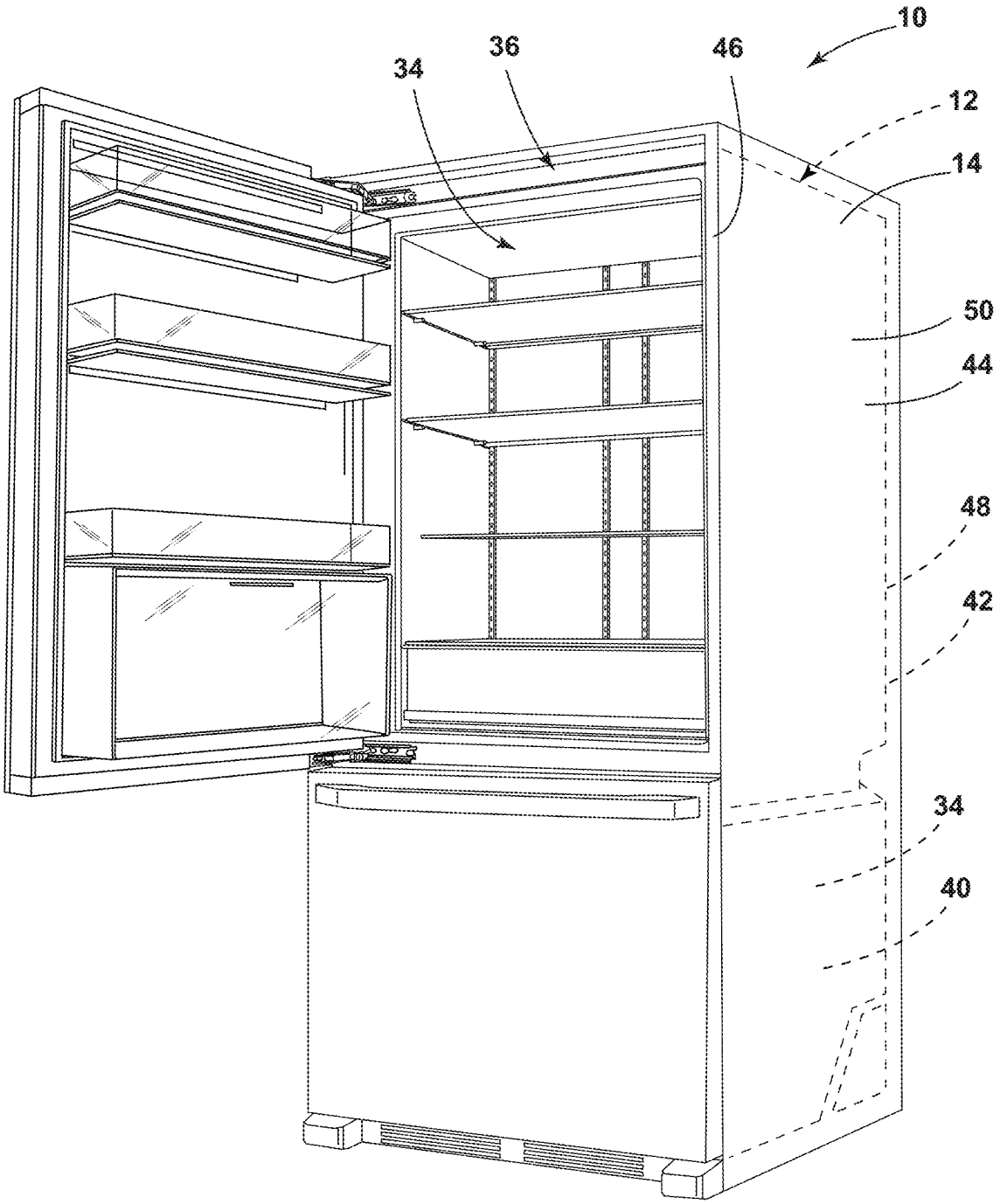
FIG. 1 is a front perspective view of a refrigeration unit illustrating a wrapper and a liner in phantom.

The components in the figures are not necessarily to scale, emphasis instead being placed upon illustrating the principles described herein.

DETAILED DESCRIPTION

The present illustrated embodiments reside primarily in combinations of apparatus components related to an insulation panel assembly for a refrigeration unit. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring now to FIGS. 1-6, reference numeral 10 generally designates a refrigeration unit. The refrigeration unit 10 includes an insulation panel assembly 12. The insulation panel assembly 12 includes a structural enclosure 14. The structural enclosure 14 defines an aperture 16 and includes a protruding surround 18 that extends around the aperture 16. An evacuation hub 20 defines an evacuation port 22 that extends from an inlet 24 to an outlet 26. The evacuation hub 20 further defines a groove 28 that extends around the inlet 24. The evacuation hub 20 is positioned such that the inlet 24 is aligned with the aperture 16 defined by the structural enclosure 14, and the groove 28 receives the protruding surround 18 of the structural enclosure 14 therein. A conduit 30 is engaged with the evacuation hub 20. The conduit 30 extends into the evacuation port 22 via the outlet 26.

Figure 2:
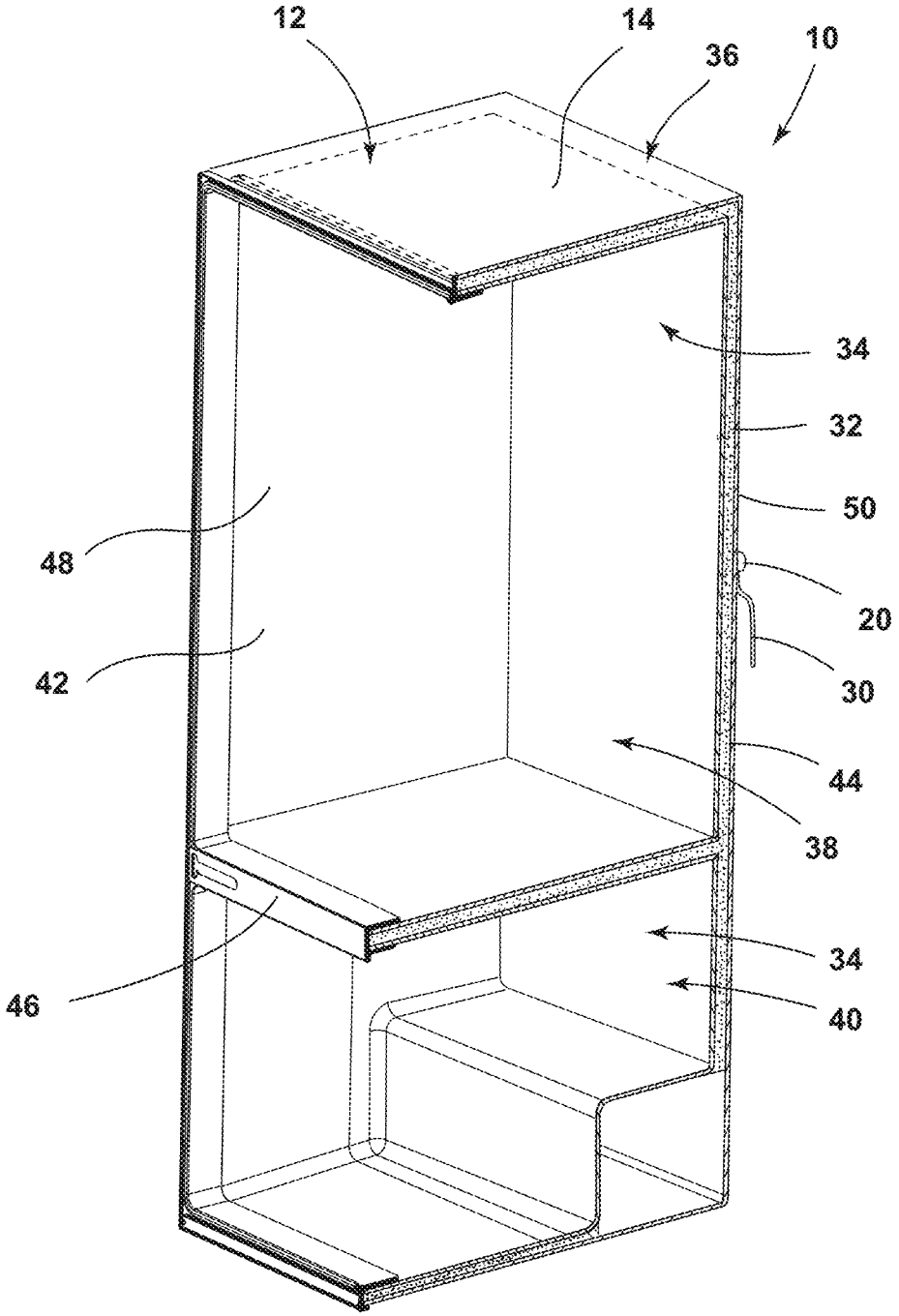
FIG. 2 is a front cross-sectional view of a structural enclosure of a refrigeration unit.
Figure 3:
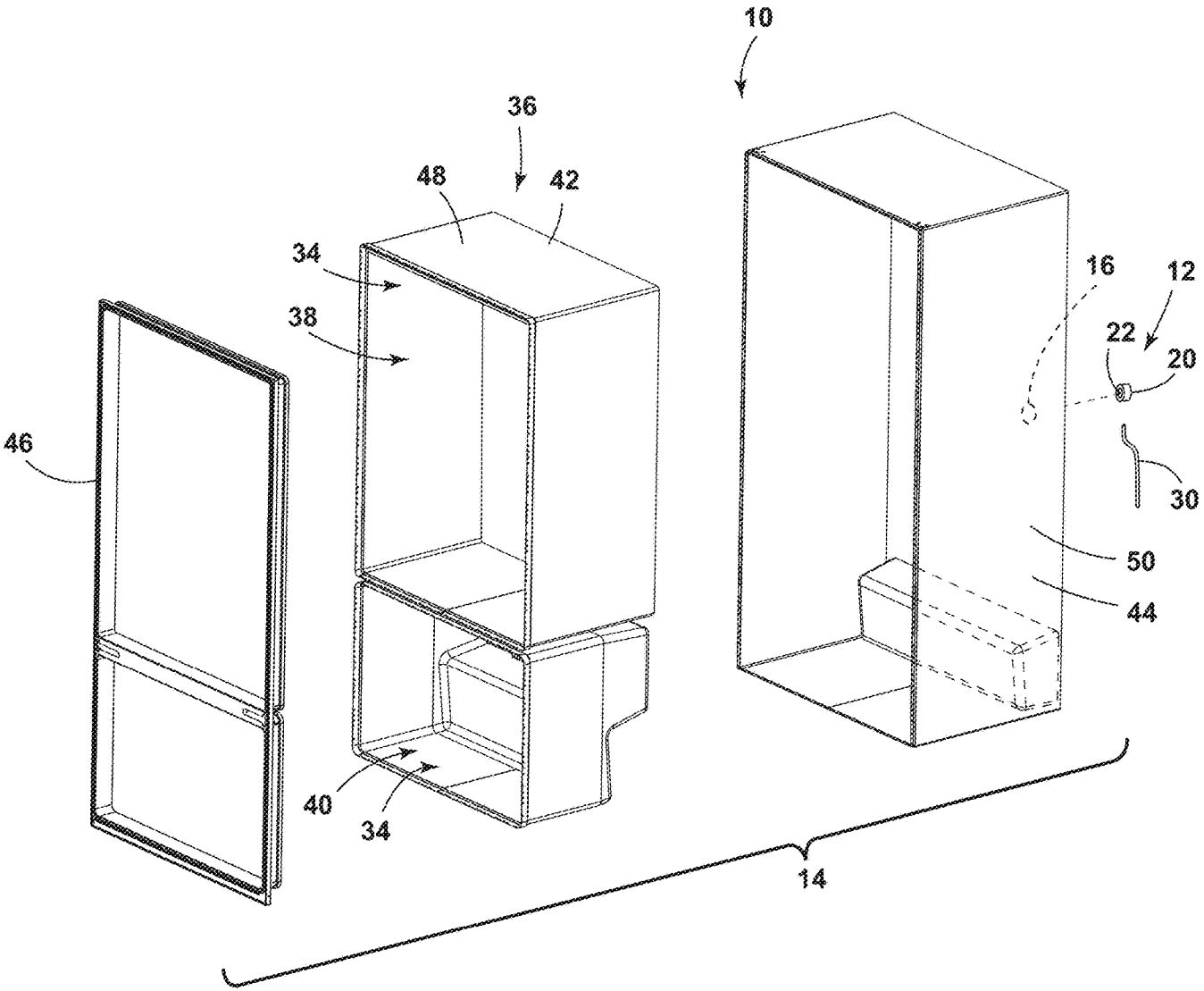
FIG. 3 is a front exploded view of the structural enclosure of FIG. 2.

Referring now to FIGS. 1-3, the refrigeration unit 10 includes the structural enclosure 14. As illustrated in FIG. 2, the structural enclosure 14 can define an insulating cavity 32. Insulation material can be disposed within the insulating cavity 32 of the structural enclosure 14. Further, in various embodiments, the structural enclosure 14 can be in the form of a vacuum insulated structural enclosure 14. As illustrated in FIGS. 1 and 2, the structural enclosure 14 can define at least one storage compartment 34 of the refrigeration unit 10. For example, as illustrated in FIG. 2, the structural enclosure 14 forms a cabinet 36 that defines a refrigeration compartment 38 and a freezer compartment 40 positioned beneath the refrigeration compartment 38. In some implementations, the structural enclosure 14 can form a panel that can be used as an insulation member for the refrigeration unit 10. For example, the structural enclosure 14 may form a vacuum insulated panel that is used in a door of the refrigeration unit 10.

Referring still to FIGS. 1-3, in some implementations, the structural enclosure 14 includes a first panel 42 and a second panel 44 coupled to the first panel 42. In various implementations, the first and second panels 42, 44 can be coupled to each other via a trim breaker 46, such that the first panel 42, the second panel 44, and the trim breaker 46 cooperate to define the insulating cavity 32 of the structural enclosure 14, as illustrated in FIG. 2. In the embodiment illustrated in FIGS. 2 and 3, the first panel 42 of the structural enclosure 14 is a liner 48 of the refrigeration unit 10, and the second panel 44 of the structural enclosure 14 is a wrapper 50 of the refrigeration unit 10. As illustrated in FIG. 2, the liner 48 defines the at least one storage compartment 34 of the refrigeration unit 10. It is contemplated that the first panel 42 can be the wrapper 50, and the second panel 44 can be the liner 48, in some implementations.

Referring now to FIGS. 2-6, the structural enclosure 14 defines an aperture 16. In some implementations, wherein the structural enclosure 14 includes the first panel 42 and the second panel 44, the second panel 44 of the structural enclosure 14 can define the aperture 16. For example, as illustrated in FIG. 3, wherein the first panel 42 is the liner 48 and the second panel 44 is the wrapper 50, the wrapper 50 defines the aperture 16. The aperture 16 defined by the structural enclosure 14 can fluidly connect the insulating cavity 32 defined by the structural enclosure 14 with an exterior environment of the structural enclosure 14, in some implementations. As described further herein, the aperture 16 defined by the structural enclosure 14 can be utilized for evacuation of the insulating cavity 32 in order to form at least a partial vacuum within the structural enclosure 14, such that the structural enclosure 14 is a vacuum insulated structural enclosure 14.

Figure 4:
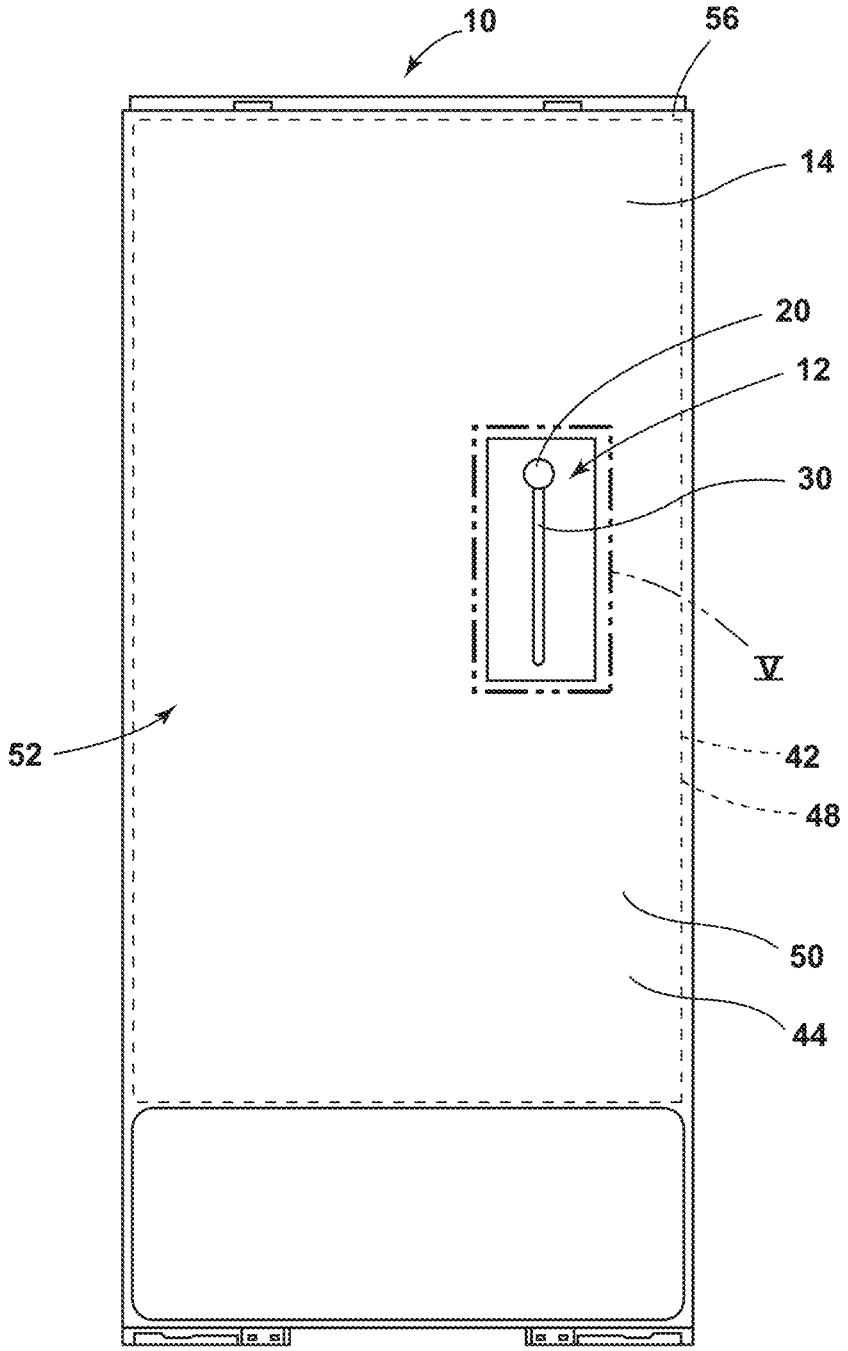
FIG. 4 is a rear elevational view of a refrigeration unit, illustrating a liner in phantom, a wrapper, an evacuation hub coupled to the wrapper, and a conduit engaged with the evacuation hub.
Figure 5:
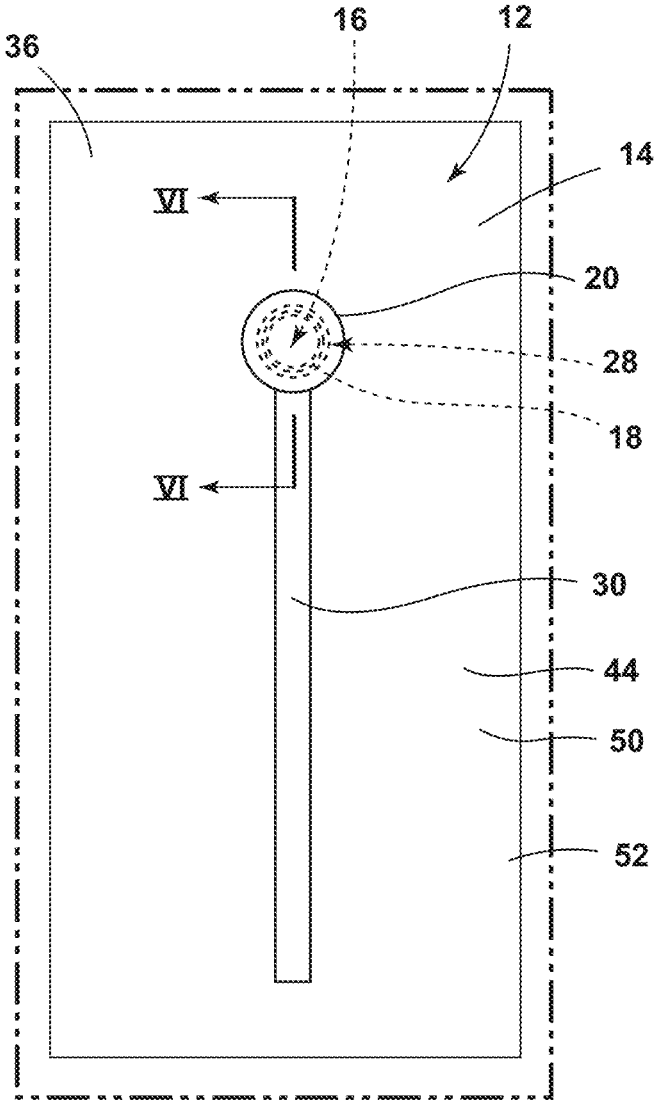
FIG. 5 is an enlarged elevational view of area V of the refrigeration unit of FIG. 4.
Figure 6:
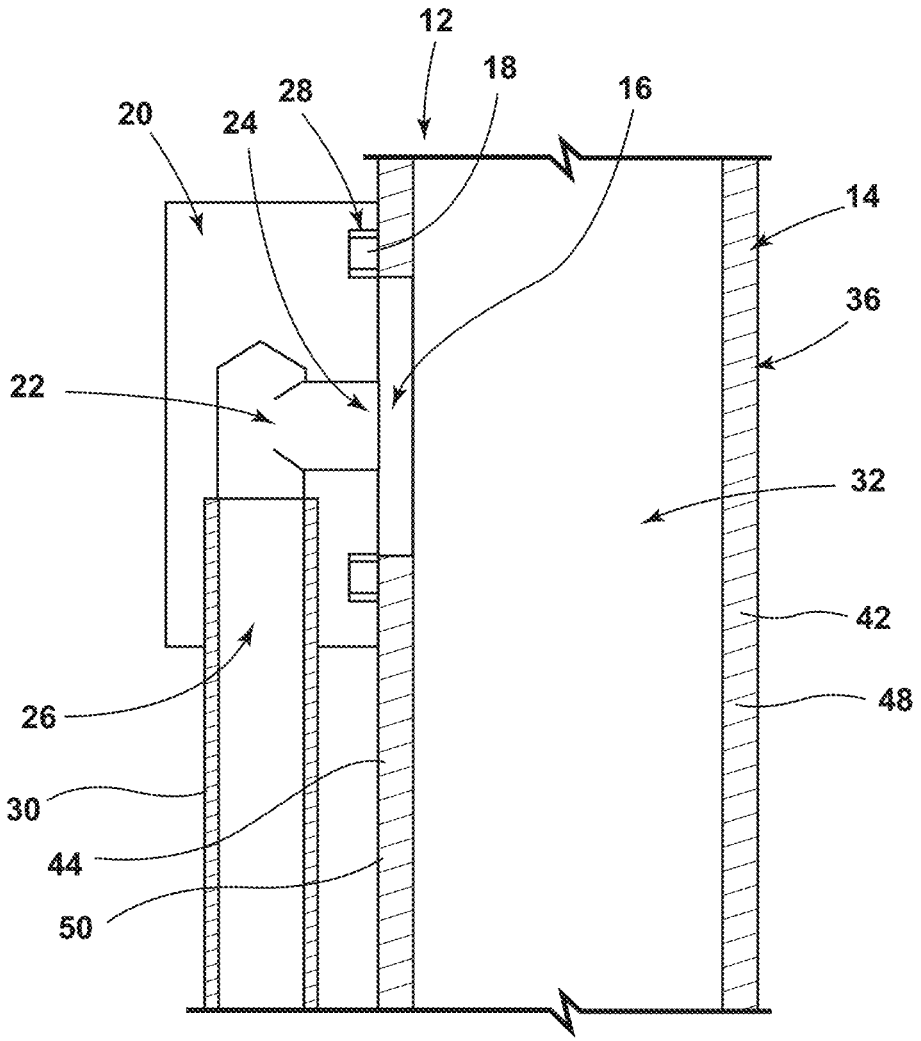
FIG. 6 is a cross-sectional view taken through line VI-VI of FIG. 5, illustrating a structural enclosure, an evacuation hub coupled to the structural enclosure, and a conduit coupled to the evacuation hub.

Referring now to FIGS. 4-6, the structural enclosure 14 can include a protruding surround 18 that extends around the aperture 16 defined by the structural enclosure 14. In some embodiments, wherein the structural enclosure 14 includes the first panel 42 and the second panel 44 coupled to the first panel 42, the second panel 44 can include the protruding surround 18. For example, in the embodiment illustrated in FIGS. 5 and 6, wherein the structural enclosure 14 includes the first panel 42 in the form of the liner 48, and the second panel 44 in the form of the wrapper 50, the protruding surround 18 extends around the aperture 16 defined by the wrapper 50 of the structural enclosure 14. In various implementations, the protruding surround 18 extends outward from an adjacent portion of the structural enclosure 14 away from the insulating cavity 32 defined by the structural enclosure 14. For example, in the embodiment illustrated in FIGS. 4-6, the aperture 16 is defined by the wrapper 50 at a rear side 52 of the refrigeration unit 10. As illustrated in FIG. 6, the protruding surround 18 extends outward from an adjacent portion of the wrapper 50 away from the insulating cavity 32 defined between the wrapper 50 and the liner 48. In some implementations, the protruding surround 18 can be an annular protruding surround 18. For example, as illustrated in FIG. 5, the protruding surround 18 is an annular protruding surround 18 that generally encircles the aperture 16 defined by the structural enclosure 14. It is contemplated that the protruding surround 18 can extend around the aperture 16 in a variety of manners to form a variety of shapes (e.g., oval, square, hexagonal, etc.), in various embodiments.

Referring still to FIGS. 4-6, the insulation panel assembly 12 includes the evacuation hub 20. As illustrated in FIG. 6, the evacuation hub 20 defines the evacuation port 22. The evacuation port 22 extends from the inlet 24 to the outlet 26. As further illustrated in FIG. 6, the evacuation hub 20 defines the groove 28. The groove 28 defined by the evacuation hub 20 extends around the inlet 24 of the evacuation port 22. As illustrated in FIG. 5, in some implementations, the groove 28 is an annular groove 28 that encircles the inlet 24 of the evacuation port 22. It is contemplated that the groove 28 can extend around the inlet 24 of the evacuation port 22 in a variety of manners, such that the groove 28 can form at least one of a variety of shapes.

Referring now to FIGS. 5 and 6, the evacuation hub 20 is coupled to the structural enclosure 14. As illustrated in FIG. 6, the evacuation hub 20 is positioned relative to the aperture 16 defined by the structural enclosure 14, such that the inlet 24 of the evacuation port 22 is aligned with the aperture 16 defined by the structural enclosure 14, and the groove 28 defined by the evacuation hub 20 receives the protruding surround 18 of the structural enclosure 14 therein. In the embodiment illustrated in FIG. 6, wherein the second panel 44 includes the annular protruding surround 18 and defines the aperture 16, the evacuation hub 20 is positioned such that the inlet 24 of the evacuation port 22 is aligned with the aperture 16 defined by the second panel 44, and the annular protruding surround 18 of the second panel 44 is received within the annular groove 28 defined by the evacuation hub 20.

The insulation panel assembly 12 further includes the conduit 30. The conduit 30 is configured to be engaged with the evacuation hub 20. As illustrated in FIG. 6, the conduit 30 extends into the evacuation port 22 through the outlet 26 of the evacuation port 22. In various implementations, the conduit 30 is engaged with the evacuation hub 20 such that the evacuation hub 20 and the conduit 30 are substantially sealed to allow for evacuation of the structural enclosure 14 through the aperture 16, the evacuation port 22, and the conduit 30 in series. In various embodiments, the conduit 30 can be a metal conduit 30. For example, the conduit 30 can be a copper tube, in some implementations. A variety of types of conduit 30 are contemplated.

Referring still to FIGS. 5 and 6, the evacuation hub 20 can be formed of one or more of a variety of materials. For example, in some implementations, the evacuation hub 20 can be a metal evacuation hub 20. In some implementations, the evacuation hub 20 can be a plastic evacuation hub 20. A variety of types of metals and plastics are contemplated. In some implementations, the evacuation hub 20 is coupled to the structural enclosure 14 via an adhesive 54. For example, in the embodiment illustrated in FIG. 6, the evacuation hub 20 is coupled to the second panel 44 of the structural enclosure 14 via the adhesive 54. A variety of types of adhesives 54 are contemplated (e.g., glue, mucilage, paste, cement, etc.). The conduit 30 can be engaged with the evacuation hub 20 in a variety of manners. In some implementations, wherein the evacuation hub 20 is a metal evacuation hub 20 and the conduit 30 is a metal conduit 30, the conduit 30 can be soldered with the metal evacuation hub 20. In some implementations, wherein the evacuation hub 20 is a plastic evacuation hub 20, the conduit 30 is coupled with the evacuation hub 20 via the adhesive 54. In some implementations, the evacuation 20 hub is overmolded onto the conduit 30. For example, the evacuation hub 20 can be a plastic evacuation hub 20 that is injection molded over a portion of the conduit 30, such that the evacuation hub 20 and the conduit 30 are engaged with each other. In some implementations, the conduit 30 can be coupled with the evacuation hub 20 via the adhesive 54. For example, in some implementations, wherein the conduit 30 is a metal conduit 30 and the evacuation hub 20 is a plastic evacuation hub 20, the metal conduit 30 can be glued to the plastic evacuation hub 20, such that the conduit 30 and the evacuation hub 20 are engaged with each other.

Figure 7:
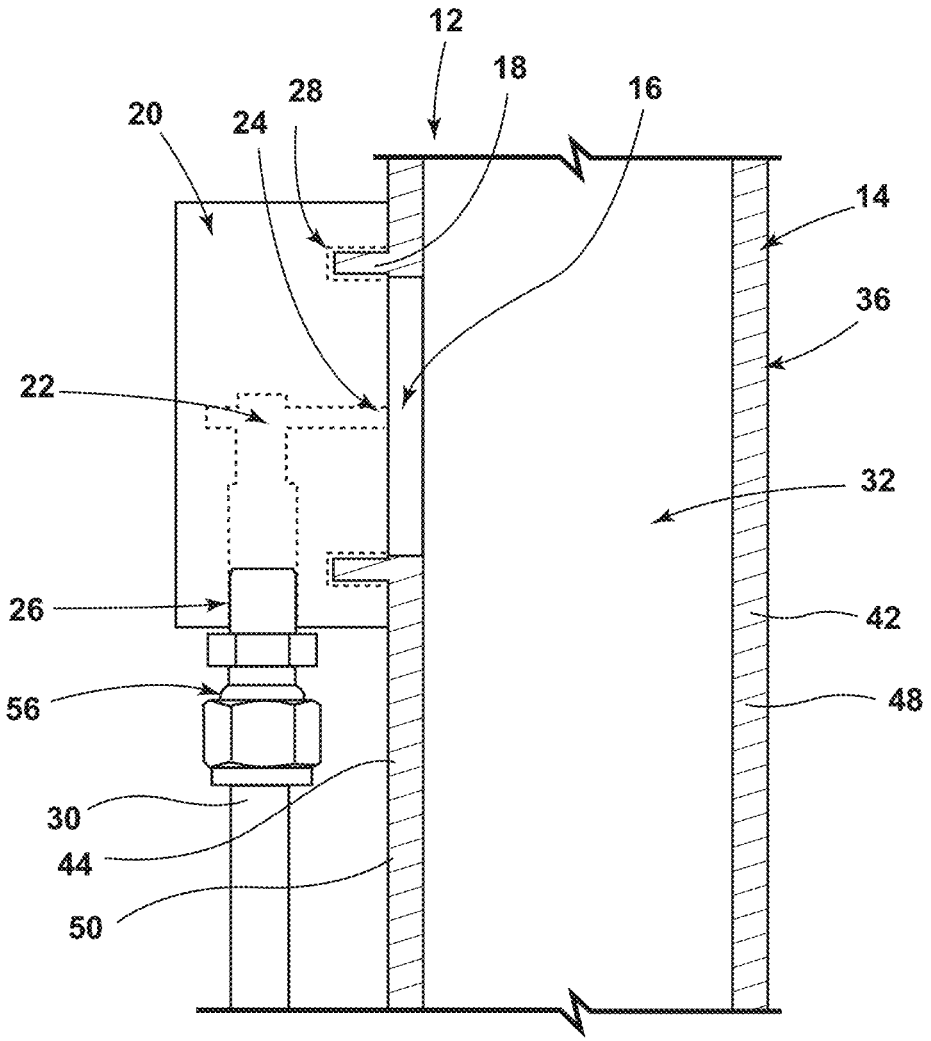
FIG. 7 is a cross-sectional view of an insulation panel assembly illustrating an evacuation hub coupled to a structural enclosure, an adapter engaged with the evacuation hub, and a conduit engaged with the adapter.

Referring now to FIG. 7, in some implementations, the insulation panel assembly 12 can include an adapter 56. The adapter 56 couples the conduit 30 with the evacuation hub 20, as illustrated in FIG. 7. As such, in some implementations, the conduit 30 can be engaged with the evacuation hub 20 via the adapter 56. The adapter 56 can be engaged with the conduit 30 via a compression fitting. In other words, the adapter 56 can be press fit with the conduit 30 such that the adapter 56 and the conduit 30 are engaged with each other. In an exemplary embodiment, the adapter 56 is formed of metal, and the conduit 30 is the metal conduit 30 (e.g., a copper conduit 30). Various combinations of materials for the adapter 56 and the conduit 30 (e.g., metals, plastics, etc.) are contemplated. The adapter 56 can be engaged with the evacuation hub 20 via a threaded connection. In various implementations, the adapter 56 and the evacuation hub 20 are metal and at least one of the adapter 56 and the evacuation hub 20 includes threads that facilitate the threaded engagement. It is contemplated that the adapter 56 can be engaged with the evacuation hub 20 in one or more of a variety of manners (e.g., soldering, adhesives, etc.).

In operation of an exemplary embodiment of the insulating panel assembly 12, insulation materials may be disposed within the insulating cavity 32 defined by the structural enclosure 14. The insulating materials may be a variety of types of insulating materials, such as a glass-type material, a carbon-based powder, silicon oxide-based materials, insulating gases, and other standard insulation materials. The insulation materials can substantially fill the insulating cavity 32 forming a substantially continuous layer between the liner 48 and the wrapper 50, in various implementations. Next, an evacuator is operably coupled with the conduit 30, and the evacuator evacuates the structural enclosure 14 through the aperture 16, the evacuation port 22 defined by the evacuation hub 20, and the conduit 30, such that the structural enclosure 14 forms at least a partial vacuum. The conduit 30 is then crimped to generally maintain the partial vacuum of the structural enclosure 14.

According to one aspect of the present disclosure, an insulation panel assembly for a refrigeration unit includes a first panel, a second panel coupled to the first panel, an evacuation hub defining an evacuation port that extends from an inlet to an outlet and a groove that extends around the inlet, and a conduit engaged with the evacuation hub. The second panel defines an aperture and includes a protruding surround that extends around the aperture. The evacuation hub is positioned such that the inlet is aligned with the aperture defined by the second panel and the groove receives the protruding surround of the second panel therein. Further, the conduit extends into the evacuation port via the outlet.

According to another aspect, the protruding surround is annular, and the groove is an annular groove that encircles the inlet.

According to another aspect, the first panel is a liner of the refrigeration unit and the second panel is a wrapper of the refrigeration unit.

According to another aspect, the evacuation hub is coupled to the second panel via an adhesive.

According to another aspect, the evacuation hub is a metal evacuation hub, and the conduit is soldered with the metal evacuation hub.

According to another aspect, the evacuation hub is a plastic evacuation hub.

According to another aspect, the conduit is coupled with the plastic evacuation hub via an adhesive.

According to another aspect, the evacuation hub is overmolded onto the conduit.

According to another aspect of the present disclosure, an assembly for a refrigeration unit includes a structural enclosure that defines an aperture and includes a protruding surround that extends around the aperture, an evacuation hub defining an evacuation port that extends from an inlet to an outlet and a groove that extends around the inlet, and a conduit engaged with the evacuation hub. The evacuation hub is positioned such that the inlet is aligned with the aperture defined by the structural enclosure and the groove receives the protruding surround of the structural enclosure therein.

According to another aspect, the evacuation hub is coupled to the structural enclosure via an adhesive.

According to another aspect, the evacuation hub is a metal evacuation hub, and the conduit is soldered with the metal evacuation hub.

According to another aspect, the evacuation hub is a plastic evacuation hub.

According to another aspect, the conduit is engaged with the plastic evacuation hub via an adhesive.

According to another aspect, the evacuation hub is overmolded onto the conduit.

According to another aspect, the protruding surround is annular, and the groove is an annular groove that encircles the inlet.

According to another aspect, wherein the conduit is engaged with the evacuation hub via an adapter that is engaged with the conduit and the evacuation hub, wherein the adapter is engaged with the conduit via a compression fitting, and the adapter is engaged with the evacuation hub via a threaded connection.

According to yet another aspect of the present disclosure, an insulation panel assembly for a refrigeration unit includes a liner, a wrapper coupled to the liner, such that the liner and wrapper define an insulating cavity therebetween, an evacuation hub defining an evacuation port that extends from an inlet to an outlet and an annular groove that encircles the inlet, and a conduit engaged with the evacuation hub. The wrapper defines an aperture and includes an annular protruding surround that extends away from the insulating cavity and around the aperture. The evacuation hub is positioned such that the inlet is aligned with the aperture defined by the wrapper and the annular groove receives the annular protruding surround. Further, the conduit extends into the evacuation port via the outlet.

According to another aspect, the liner is coupled with the wrapper via a trim breaker.

According to another aspect, the conduit is engaged with the evacuation hub via an adhesive.

According to another aspect, the evacuation hub is overmolded onto the conduit, such that the conduit is engaged with the evacuation hub.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An insulation panel assembly for a refrigeration unit, comprising:

a first panel;

a second panel coupled to the first panel, wherein the second panel defines an aperture and includes a protruding surround that extends around the aperture;

an evacuation hub defining an evacuation port that extends from an inlet to an outlet and a groove that extends around the inlet, wherein the evacuation hub is positioned such that the inlet is aligned with the aperture defined by the second panel and the groove receives the protruding surround of the second panel therein; and a conduit engaged with the evacuation hub, wherein the conduit extends into the evacuation port via the outlet, wherein the evacuation hub is coupled to the second panel via an adhesive, the evacuation hub is a metal evacuation hub, and the conduit is soldered with the metal evacuation hub.

2. The insulation panel assembly of claim 1, wherein the protruding surround is annular, and the groove is an annular groove that encircles the inlet.

3. The insulation panel assembly of claim 1, wherein the first panel is a liner of the refrigeration unit, and the second panel is a wrapper of the refrigeration unit.

4. The insulation panel assembly of claim 1, wherein the evacuation hub is a plastic evacuation hub.

5. The insulation panel assembly of claim 4, wherein the conduit is coupled with the plastic evacuation hub via an adhesive.

6. The insulation panel assembly of claim 4, wherein the evacuation hub is overmolded onto the conduit.

7. An assembly for a refrigeration unit, comprising:

a structural enclosure that defines an aperture and includes a protruding surround that extends around the aperture and protrudes outward from an adjacent portion of the structural enclosure axially with respect to a through axis of the aperture;

an evacuation hub defining an evacuation port that extends from an inlet to an outlet and a groove that extends around the inlet, wherein the evacuation hub is positioned such that the inlet is aligned with the aperture defined by the structural enclosure and the groove receives the protruding surround of the structural enclosure therein; and a conduit engaged with the evacuation hub.

8. The assembly of claim 7, wherein the evacuation hub is coupled to the structural enclosure via an adhesive.

9. The assembly of claim 8, wherein the evacuation hub is a metal evacuation hub, and the conduit is soldered with the metal evacuation hub.

10. The assembly of claim 7, wherein the evacuation hub is a plastic evacuation hub.

11. The assembly of claim 10, wherein the conduit is engaged with the plastic evacuation hub via an adhesive.

12. The assembly of claim 10, wherein the evacuation hub is overmolded onto the conduit.

13. The assembly of claim 7, wherein the protruding surround is annular, and the groove is an annular groove that encircles the inlet.

14. The assembly of claim 7, wherein the conduit is engaged with the evacuation hub via an adapter that is engaged with the conduit and the evacuation hub, wherein the adapter is engaged with the conduit via a compression fitting, and the adapter is engaged with the evacuation hub via a threaded connection.

15. An insulation panel assembly for a refrigeration unit, comprising:

a liner;

a wrapper coupled to the liner, such that the liner and wrapper define an insulating cavity therebetween, wherein the wrapper defines an aperture and includes an annular protruding surround that extends away from the insulating cavity and around the aperture;

an evacuation hub defining an evacuation port that extends from an inlet to an outlet and an annular groove that encircles the inlet, wherein the evacuation hub is positioned such that the inlet is aligned with the aperture defined by the wrapper and the annular groove receives the annular protruding surround; and a conduit engaged with the evacuation hub, wherein the conduit extends into the evacuation port via the outlet.

16. The insulation panel assembly of claim 15, wherein the liner is coupled with the wrapper via a trim breaker.

17. The insulation panel assembly of claim 15, wherein the conduit is engaged with the evacuation hub via an adhesive.

18. The insulation panel assembly of claim 15, wherein the evacuation hub is overmolded onto the conduit, such that the conduit is engaged with the evacuation hub.

* * * * *